US006182877B1

(12) United States Patent
Rolfe

(10) Patent No.: US 6,182,877 B1
(45) Date of Patent: Feb. 6, 2001

(54) ACCESSORY ARTICLE CARRYING BAG DEVICE FOR A CANE

(76) Inventor: Andrew Q. Rolfe, 10 Gracie Sq., New York, NY (US) 10028-8031

( * ) Notice: Under 35 U.S.C. 154(b), the term of this patent shall be extended for 0 days.

(21) Appl. No.: 09/348,306

(22) Filed: Jul. 7, 1999

(51) Int. Cl.[7] ..... B60R 9/00

(52) U.S. Cl. ..... 224/407; 224/220; 224/584; 383/16; 135/66; D3/10; D3/11

(58) Field of Search ..... 224/407, 584, 224/600, 604, 605, 607, 615, 620, 220, 235, 246; 383/16, 24, 75, 4; D3/7, 8, 10, 11; 135/66

(56) References Cited

U.S. PATENT DOCUMENTS 4,815,640 * 3/1989 Johnson ..... 383/75 X
5,158,220 * 10/1992 Glass ..... 224/235 X
5,618,110 * 4/1997 Sullivan ..... 383/75 X
5,711,334 * 1/1998 Roux ..... 135/65
6,026,833 * 2/2000 Conte ..... 224/407 X

* cited by examiner

*Primary Examiner*—Gregory M. Vidovich
*Assistant Examiner*—Maerena W. Brevard
(74) *Attorney, Agent, or Firm*—Carella, Byrne, Bain, Gilfillan et al; John G. Gilfillan; William Squire

(57) ABSTRACT

A cane with an arm cuff C-clamp and a lateral handle has an accessory article carrying sack comprising a cloth or other material drawstring sack attached to the C clamp with a loop of the drawstring. Clips attach the sack to the leg of the cane to hold the open bag top closed and to keep the sack from moving about as the person using the accessory walks. Various embodiments of clips and fasteners are disclosed for attaching the sack to the cane leg and for precluding lateral displacement of the sack during walking of the user.

15 Claims, 4 Drawing Sheets

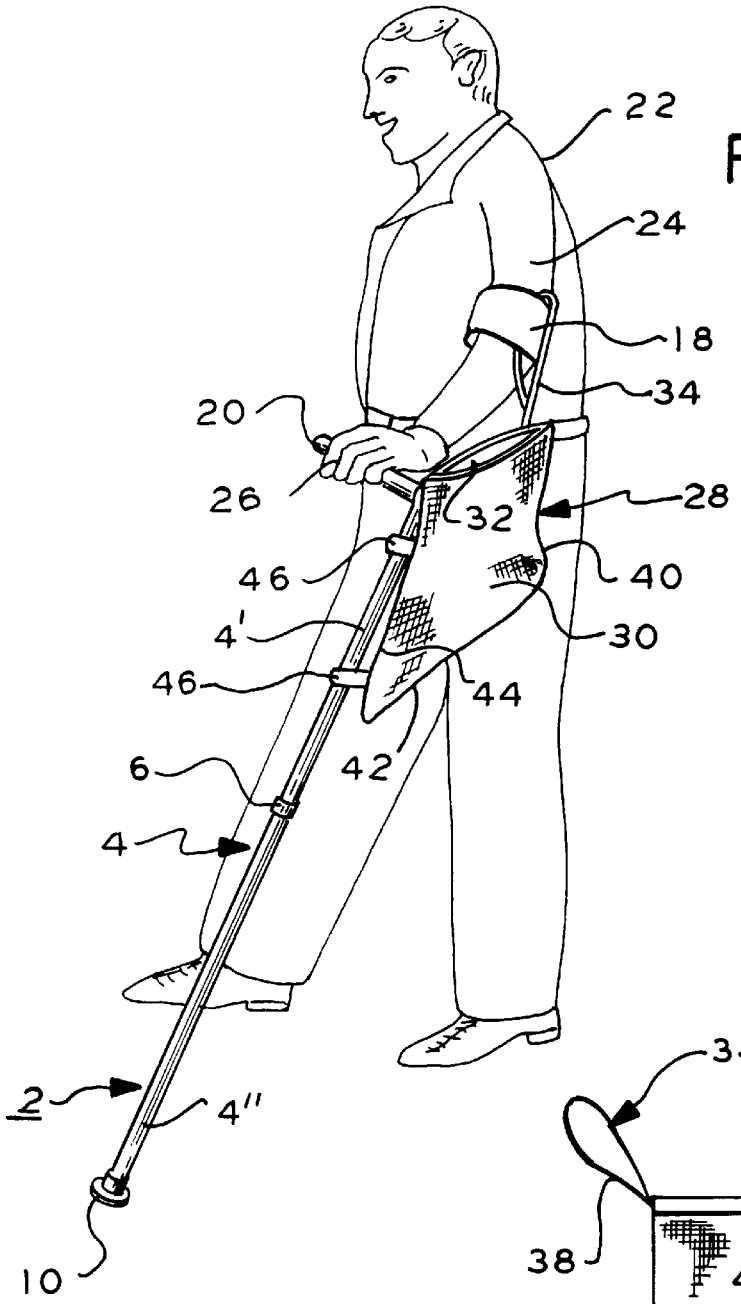
FIG. 1
FIG. 3
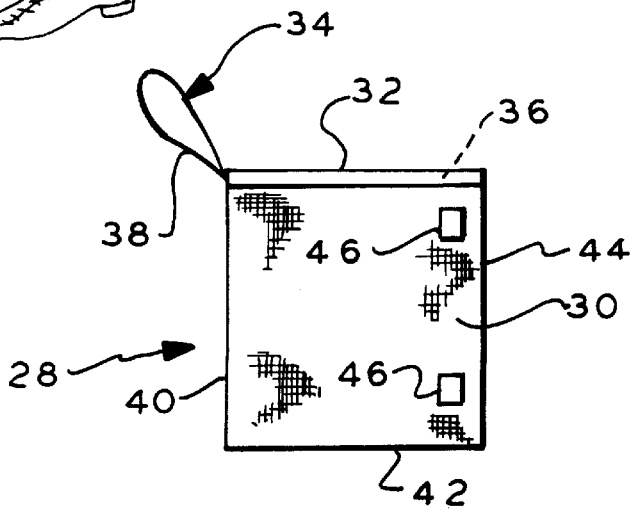

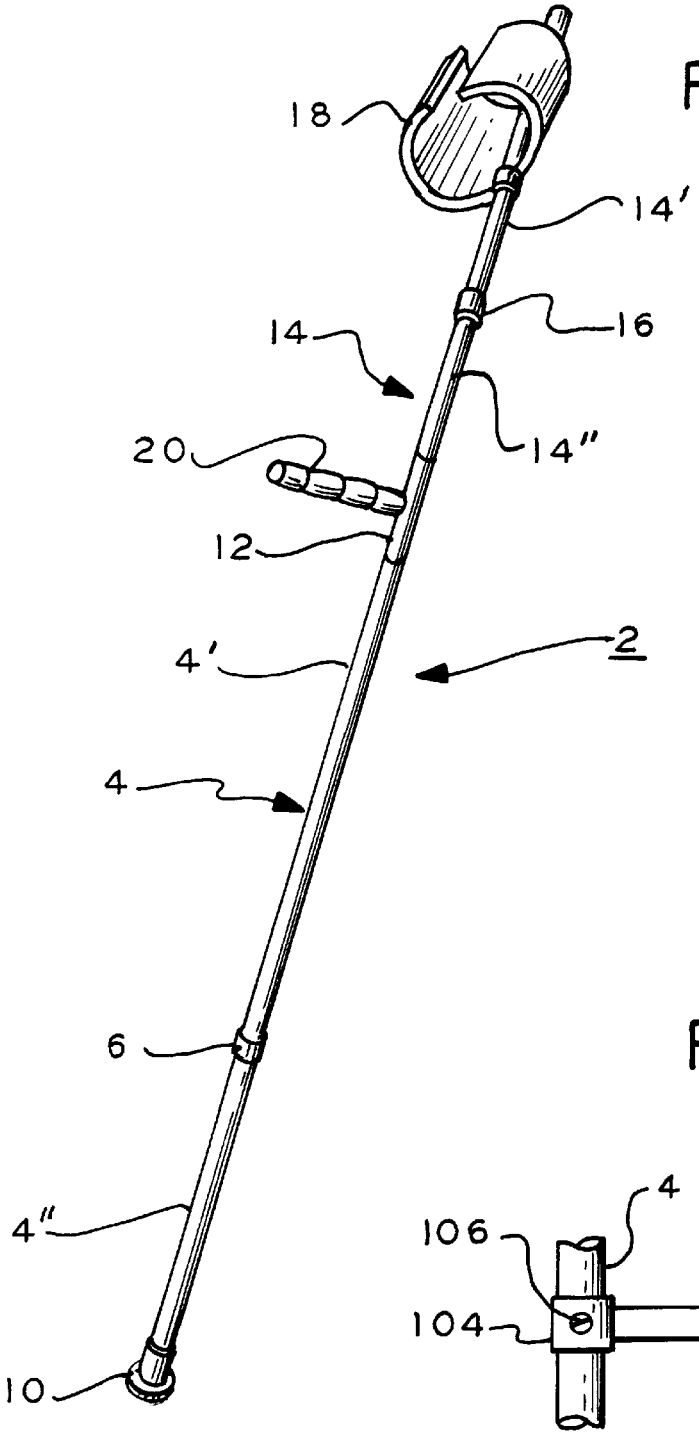
FIG. 2
FIG. 10
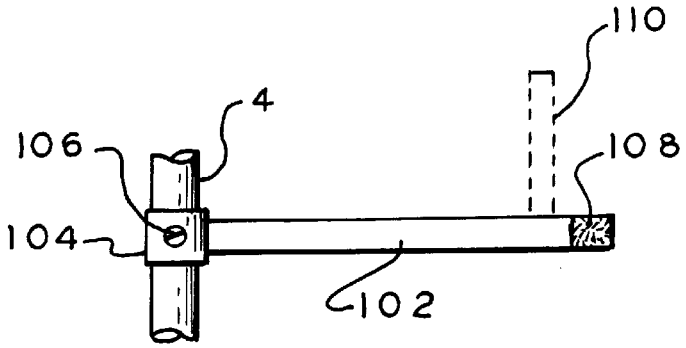

ACCESSORY ARTICLE CARRYING BAG DEVICE FOR A CANE

This invention relates to sacks for carrying articles, the sack being releasably attachable to a cane.

Accessory bags and sacks for use with canes typically hang from the cane and are annoying to the user because they tend to flap about as the user walks. This is unsatisfactory and detracts from the use of such bag accessories.

An accessory article carrying bag device according to the present invention is for use with a cane having a leg, a hand grip extending laterally from the leg and an arm support member integral with and extending from the leg and including a C-shaped arm cuff clamp secured to and extending laterally from the arm support member for releasably engaging the arm of a person. The device comprises a collapsible drawstring sack having an open top and a closed bottom and first and second spaced opposite edges extending between and to the top and bottom. A drawstring is slidably attached to and has a portion extending from the sack at the sack top and at the first edge for selectively closing the top, the drawstring extending portion for engaging the C-shaped clamp. At least one fastener attaches the sack at a region distal the first edge to the leg.

In one embodiment, the device further includes a stiffening element secured to the sack and arranged to be non-rotatably secured to the cane leg for precluding lateral displacement of the sack relative to the cane leg.

In a further embodiment the fastener means include a plurality of fasteners attached to the sack in spaced relation so that the draw string cooperates with the fasteners to secure the sack to the cane for precluding the sack from displacing laterally relative to the cane during use.

In a further aspect, an accessory article carrying bag device according to the present invention is for use with a cane comprising at least one elongated member, the device comprising a flexible collapsible sack having an open top and a closed bottom and first and second spaced opposite edges extending between the top and bottom. A string is attached to the sack for closing the sack top and has a portion extending from the sack at the sack top adjacent to the first edge for forming a loop extending from the sack top. At least one fastener is included for attaching the sack in a region adjacent to the second edge to the tubular member.

In a further aspect, the at least one fastener comprises a pair of fasteners attached in a sack region adjacent to the second edge in spaced relation.

In a further aspect, one of the fasteners is located adjacent to the top and the other fastener is located adjacent to the bottom.

In a further aspect, the at least one fastener comprises first and second elements, the first element being secured to the sack and the second element for attachment to the elongated member for attaching the first element to the elongated member.

An accessory article carrying bag device for use with a cane comprising an elongated member comprises in a further aspect a flexible collapsible sack having an open top and a closed bottom and first and second spaced opposite edges extending between and in a direction toward the top and bottom. A string is attached to the sack for closing the sack top and having a portion extending from the sack top adjacent to the first edge for forming a loop extending from the sack top). At least one fastener attaches the sack to the cane leg.

The at least one fastener preferably comprises a pair of fasteners attached in a region adjacent to the second edge in spaced relation.

In a further aspect, one of the fasteners is located adjacent to the top and the other fastener is located adjacent to the bottom.

Preferably, the fastener comprises first and second elements, the first element being secured to the sack and the second element for attachment to the tubular member for attaching the first element to the tubular member.

An accessory article carrying bag device for use with a cane in a further embodiment comprises a collapsible drawstring sack, the drawstring for closing a sack open top and fastener means cooperating with the drawstring for securing the sack to the cane so the sack top is substantially closed.

The fastener means preferably include a plurality of fasteners attached to the sack in spaced relation so that the draw string cooperates with the fasteners to secure the sack to the cane so that the sack is precluded from substantial lateral displacement relative to the cane during use.

In a further embodiment, a stiffening element is arranged to be non-rotatably secured to the leg and including means for securing the sack to the element to preclude substantial lateral displacement of the sack relative to the cane.

IN THE DRAWING

FIG. 1 is a perspective view of a person, cane and article carrying device according to one embodiment of the present invention;

FIG. 2 is a perspective view of the cane of FIG. 1;

Figure 4A:
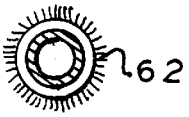
Figure 4B:
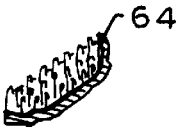
Figure 3A:
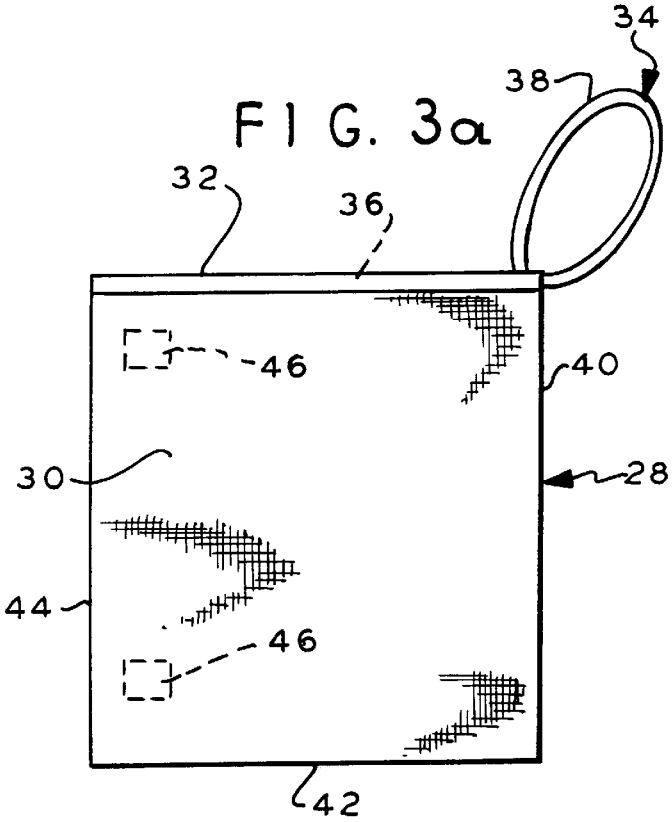
FIG. 3 is a side elevation rear view of the article carrying device of FIG. 1.

FIG. 3*a* is a side elevation front view of the device of FIG. 1;

FIG. 4*a* is a plan sectional view of one embodiment of one element of a hook-loop fastener for attaching the device sack of FIG. 1 to a cane leg;

FIG. 4*b* is an isometric view of a mating fastener element for use with the fastener element of FIG. 4*a;*

Figure 5:
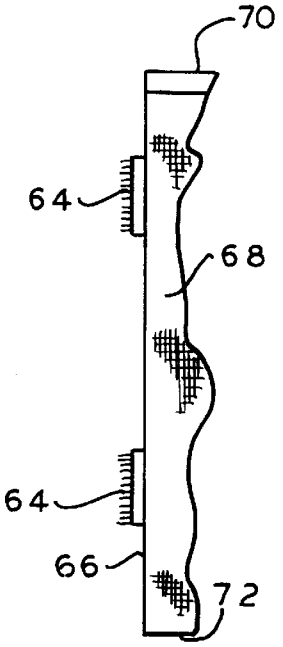
Figure 6:
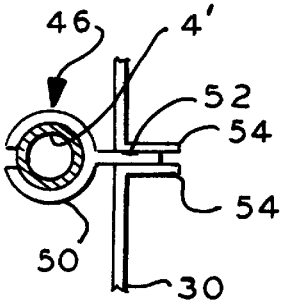
Figure 7:
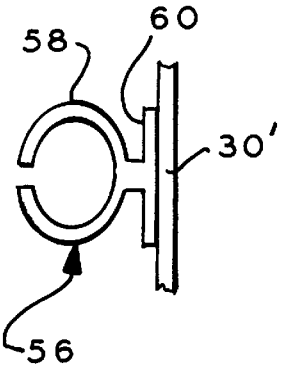
Figure 8:
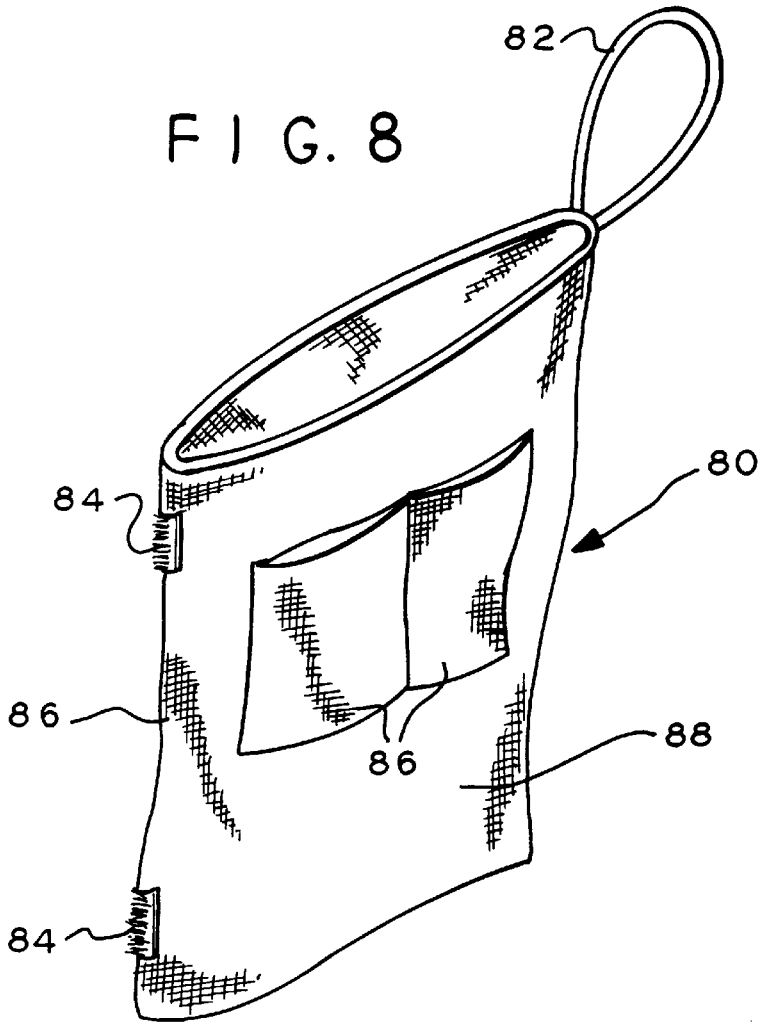
Figure 9:
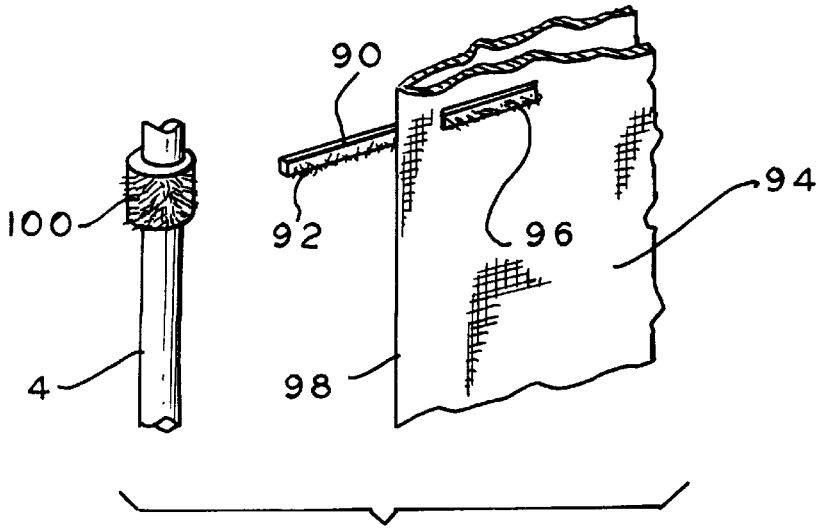

FIG. 5 is a fragmented side elevation view of a further embodiment of the fastener-sack arrangement of the present invention;

FIGS. 6 and 7 are respective plan views of a C-shaped fastener embodiment of the present invention for attaching the sack device of FIG. 1 to a cane;

FIG. 8 is a perspective view of an article carrying device according to a further embodiment of the present invention;

FIG. 9 is a perspective exploded view of a further embodiment; and

FIG. 10 is an elevation view of a further embodiment of a device for non-rotatably securing a sack to the cane.

In FIGS. 1 and 2, cane 2 comprises a straight metal tubular leg 4 comprising two telescoping sections 4' and 4". Adjustment device 6 adjusts the length of the leg 4. Leg 4 includes an upper metal tubular arm support member 14 that extends linearly from section 4'. The member 14 has two telescoping sections 14' and 14" adjustably joined by adjustment device 16. A conventional C-shaped arm cuff or clamp 18 is fixed to the section 14' in a conventional manner, the cane 2 being conventional and commercially available and sometimes referred to as a "Canadian Cane." The clamp 18 snaps over a users arm and holds the cane upper end member 14 to the arm 24.

A hand grip 20, a metal tube, for example, with a soft grip thereabout extends laterally from a T-shaped coupler 12 attached to the junction of leg 4 and member 14. In practice, the leg section 4' and member 14" is a one piece integral tube.

FIG. 1 shows typical use of the cane 2 by a person 22. The clamp 18 engages the arm 24 and the hand 26 grips the hand grip 20. The leg 4 has a rubber, elastomeric or other material tip 10 to grip the floor.

Article carrying bag device 28 of the present invention comprises a sack 30 made preferably of any desired sheet fabric, cloth, plastic material, woven or solid sheet material. The sack 30 is generally rectangular, but may be other shapes, and has an open top 32. In FIGS. 3 and 3*a* the bag device 28 has a drawstring 34 which is looped through a channel 36 formed in the sack 30 at the open top 32. The drawstring 34 in this embodiment forms a loop 38 which extends from the sack 30 at one side edge 40 of the sack. It should be understood that a generally cylindrical sack will define opposing edges when flattened. The term edge does not and is not intended to connote a seam. A sack with a single vertical seam when flattened will have opposing edges.

The edge 40 of the flattened sack extends from the open top 32 to the closed bottom 42, the sack being fully enclosed except for the open top. A second side edge 44 opposite edge 40 extends from the top to bottom. A seam (not shown) in the sack does not necessarily have to be at one of the edges.

A pair of clips 46 are adjacent to the edge 44 and are respectively adjacent to the top and bottom of the sack 30. The clips may be at or on the edges or spaced from the edges as shown. The clips 46 may be identical. The clips 46 engage the leg 4 section 4'.

In FIG. 6, representative clip 46 comprises a C-shaped molded thermoplastic member having a C-section 50 for grasping section 4' and a flap 52 for being preferably sewn or glued between adjacent edge portions 54 of the sack 30. The C section 50 snaps over the leg section 4'.

In FIG. 7, clip 56 in the alternative comprises a thermoplastic C section 58 molded to a flange 60 which is glued, riveted or sewn to the sack 30'.

In FIGS. 4*a* and 4*b*, hook and loop fasteners 62 and 64 such as VELCRO, a trademark for such a fastener arrangement, may be used to attach the sack 30 to the leg 4 adjacent to one edge of the sack. The fasteners do not have to be at the edges but may be spaced therefrom.

In FIG. 4*a*, fastener 62 comprises an annular strap of hook or loop fibers glued or otherwise fastened about the leg 4 in the desired length location. A fastener 64 of a mating set of loop or hook fibers, FIG. 4*b*, is glued or sewn to the sack 30 in the desired locations. In FIG. 5, for example, the fasteners 64 are attached to edge 66 of sack 68 in spaced relation to each other and adjacent to the top 70 and bottom 72 of the sack. In this embodiment, the fasteners are at the edges and spaced from the top and bottom. They may in the alternative be spaced from the edges and/or be also at the top and bottom edges as well. Further hook and loop fasteners (not shown) or clips may also be used to further secure the sack to the leg 4. This securing action precludes the sack from riding or displacing up and down the cane leg 4 as the person walks.

In FIG. 8, bag device 80 has a drawstring 82 and two spaced loop or hook fasteners 84 on edge 86. A pair of pockets are on a side of the sack 88. The fasteners 84 attach to fasteners 62, FIG. 4*a*, secured to the leg 4.

In the alternative, in FIG. 9, a VELCRO fastener 90 comprises a strap having a free end 92 and whose other end is fixed to sack 94. A mating VELCRO fastener 96 is secured to the sack 94 on a side opposite the fastener 90 at edge 98. An optional VELCRO fastener 100 mating with fastener 90 is glued or otherwise fastened to leg 4. The strap fastener 90 is wrapped about the leg 4 and fastener 100 and releasably attached to fastener 96. The VELCRO fasteners need not be attached to the leg 4 as the sack need only be attached to the leg by loops or clips to hold the sack to the leg. Other fasteners including plain straps or ties may be used to attach the sack to the leg 4. Such straps or ties may be sewn or glued to the sack, for example.

In operation, in FIG. 1, sack 30 is attached to the arm cuff C-clamp 18 by way of the loop 38 on the drawstring 34 (FIG. 3). The sack hangs from the clamp 18. This secures one edge 40 of the flattened sack at the top upwardly and toward the person. One of clips 46 secures the sack top and opposite edge 44 to the leg 4 and the other clip 46 secures the sack bottom and edge 44 to leg 4. The clips cooperate with drawstring to hold the top 32 closed and draw the sack taut between the clips and drawstring. This tautness minimizes the sack displacing laterally as a person walks.

The sack hangs by way of the drawstring from the cuff clip 18. Thus the sack is restrained and held from moving about as the person walks. The clips 46 or comparable fasteners are sufficient to hold the sack in place in cooperation with the drawstring. All of the clips cooperate with the drawstring to hold the sack in place whether two or more clips are used. More than two clips could be used (not shown) for attaching the sack at various lateral locations adjacent the opposing sack edges to the leg 4.

The VELCRO fasteners serve the same purpose as the clips 46. The VELCRO fasteners on the cane legs help immobilize the sack from vertical movement as the person walks. However, the looping of straps or attachment of the C clips to the cane legs is sufficient to hold the sack in the desired position as a person walks. By attaching one type of VELCRO member to the cane legs and a mating member to the sack, the sack is thus quickly and easily attached to the cane without straps while the top is always pulled closed, but easily opened to insert articles into the sack.

While discrete VELCRO fasteners are shown at the top and bottom of the sack, in the alternative a VELCRO fastener or clip can extend for the full or almost full length of edge 44, if desired, to secure the sack along its entire top to bottom length to the cane leg 4. A further fastener medially the sack top and bottom at the opposite edge 40 can secure the sack somewhat folded to the leg 4 to further immobilize and minimize lateral displacement of the sack during walking.

In FIG. 10, in a further embodiment, a relatively stiff but flexible or pliable elongated sack support element 102 is clamped by clamp 104 by screw 106 to the cane leg 4. The clamp 104 precludes rotation of the element 102 about the leg 4. The element 102 may be an elongated plastic tube or rod or a sheet of relatively pliable but stiff plastic or other pliable material, for example. Such a rod, tube or sheet material is sufficiently pliable to be harmless if impacted against a person's leg, for example, during walking and sufficiently stiff to preclude lateral flopping about of the sack 30. An extension 110 shown in phantom may be attached to the element 102 normal to the element 70 to further stiffen the sack in the vertical directions between and toward the sack top and bottom in a region distal the leg 4 and adjacent to the edge 40 (FIG. 3*a*). Mating VELCRO fasteners (not shown) are attached to the sack 30 and extension 110. The shape of the element 102 and extension 110 is given by way of example and is not important and may be of any suitable configuration. A fastener 108 preferably VELCRO at the extended end of the element 102 (and the extension 110) is used to attach a mating VELCRO fastener (not shown)

attached medially or adjacent to the edge 40 to the sack 30 between the edges 40 and 44. The element 102 and extension 110 may be attached to the sack internally or externally.

In a further alternative, the sack may have a relatively stiff sheet member secured thereto externally or internally for non-rotatable fixation to the leg 4.

It will occur to one of ordinary skill that still other various modifications may be made to the disclosed embodiments. It is intended that the disclosed embodiments are given by way of illustration and not limitation. The scope of the invention is as defined in the appended claims.

What is claimed is:

1. An accessory article carrying bag device for use with a cane having a leg, a hand grip extending laterally from the leg and an arm support member integral with and extending from the leg and including a C-shaped arm cuff clamp secured to and extending laterally from the arm support member for releasably engaging the arm of a person, the device comprising:

a collapsible drawstring sack having an open top and a closed bottom and first and second spaced opposite edges extending between and to the top and bottom;

a drawstring slidably attached to and having a portion extending from the sack at the sack top and at the first edge for selectively closing the top, the drawstring extending portion for engaging said C-shaped clamp; and at least one fastener for attaching the sack at a region distal the first edge to the leg;

the at least one fastener comprising first and second fasteners secured to said sack in spaced relation in a direction from the top to the bottom and arranged to be releaseably attached to said leg.

2. The device of claim 1 wherein the leg is cylindrical, the at least one fastener comprising a flexible C-shaped clamp.

3. The device of claim 2 wherein the clamp is fastened in a region adjacent to the sack second edge.

4. The device of claim 3 wherein the clamp is molded thermoplastic having a flap for attachment to the sack.

5. The device of claim 1 wherein a first of said fasteners is adjacent to the sack top and a second fastener is adjacent to the sack bottom.

6. The device of claim 1 wherein the fasteners comprise mating hook and loop elements to form a releasable engagement wherein a first element comprising hooked filaments is secured to one of the sack and leg and a second element comprising looped filaments is secured to the other of said sack and leg.

7. The device of claim 6 wherein one of the first and second elements is a strap connected to the sack adjacent to said first edge for engaging the other of said first and second elements and wrapping about a portion of the leg, the other of said first and second elements for being secured to said first longitudinal member.

8. The device of claim 1 further including a stiffening element secured to the sack and arranged to be non-rotatably secured to the cane leg for precluding lateral displacement of the sack relative to the cane leg.

9. An accessory article carrying bag device for use with a cane comprising an elongated leg member comprising:

a flexible collapsible sack having an open top and a closed bottom and first and second spaced opposite edges extending between and in a direction toward the top and bottom;

a string attached to the sack for closing the sack top and having a portion extending from the sack top adjacent to the first edge for forming a loop extending from the sack top; and at least one fastener for attaching the sack in a region adjacent to the second edge to the leg member;

the at least one fastener comprising a pair of fasteners attached to the sack in a region at the second edge in spaced relation in a direction toward the top and bottom.

10. The device of claim 9 wherein one of said fasteners is located adjacent to the sack top and the other fastener is located adjacent to the sack bottom.

11. The device of claim 9 wherein the fastener comprises first and second elements, the first element being secured to the sack and the second element for attachment to the elongated leg member for attaching the first element to the elongated leg member.

12. The device of claim 9 including attachment means for securing the sack non-rotatably to the leg member.

13. An accessory article carrying bag device for use with a cane comprising:

a collapsible drawstring sack having an open top and a closed bottom, the drawstring for closing the sack open top; and fastener means cooperating with the drawstring for securing the sack to the cane so the sack top is substantially closed;

the fastener means include a plurality of fasteners attached to the sack in spaced relation in a direction extending toward the sack top and bottom and arranged so that the draw string cooperates with the fasteners to secure the sack to the cane and arranged so that the sack is precluded from substantial lateral displacement relative to the cane during use.

14. The device of claim 13 including a stiffening element arranged to be non-rotatably secured to the leg and means for securing the sack to the element to preclude substantial lateral displacement of the sack relative to the cane.

15. An accessory article carrying bag device for use with a cane having a cylindrical leg, a hand grip extending laterally from the leg and an arm support member integral with and extending from the leg and including a C-shaped arm cuff clamp secured to and extending laterally from the arm support member for releaseably engaging the arm of a person, the device comprising:

a collapsible drawstring sack having an open top and a closed bottom and first and second spaced opposite edges extending between and to the top and bottom;

a drawstring slidably attached to and having a portion extending from the sack at the sack top and at the first edge for selectively closing the top, the drawstring extending portion for engaging said C-shaped clamp; and at least one flexible C-shaped clamp for attaching the sack at a region distal the first edge to the leg.

* * * * *